US009573370B2

(12) United States Patent
Sasagawa et al.

(10) Patent No.: US 9,573,370 B2
(45) Date of Patent: Feb. 21, 2017

(54) LIQUID EJECTION HEAD AND LIQUID EJECTION DEVICE

(71) Applicant: CANON KABUSHIKI KAISHA, Tokyo (JP)

(72) Inventors: Naoto Sasagawa, Kashiwa (JP); Toru Nakakubo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/990,143

(22) Filed: Jan. 7, 2016

(65) Prior Publication Data

US 2016/0200103 A1 Jul. 14, 2016

(30) Foreign Application Priority Data

Jan. 8, 2015 (JP) ..... 2015-002205

(51) Int. Cl.
*B41J 2/14* (2006.01)

(52) U.S. Cl.
CPC ..... *B41J 2/14201* (2013.01); *B41J 2/14233* (2013.01); *B41J 2/14274* (2013.01); *B41J 2002/14241* (2013.01); *B41J 2002/14459* (2013.01); *B41J 2202/12* (2013.01); *B41J 2202/20* (2013.01)

(58) Field of Classification Search
CPC . B41J 2/14201; B41J 2/14233; B41J 2/14274; B41J 2002/14241; B41J 2002/14217; B41J 2202/12; B41J 2/18
See application file for complete search history.

(56) References Cited

U.S. PATENT DOCUMENTS

| | | | | |
|---|---|---|---|---|
| 8,807,713 | B2 | 8/2014 | Nakamura et al. | |
| 8,857,953 | B2 | 10/2014 | Suzuki et al. | |
| 8,876,263 | B2 | 11/2014 | Sasagawa et al. | |
| 8,985,748 | B2 | 3/2015 | Nakakubo | |
| 2013/0208059 | A1* | 8/2013 | Arimoto | B41J 2/175 347/85 |
| 2014/0191062 | A1 | 7/2014 | Sasagawa et al. | |
| 2014/0359984 | A1 | 12/2014 | Kashu et al. | |

FOREIGN PATENT DOCUMENTS

| | | |
|---|---|---|
| JP | 5212627 B2 | 6/2013 |

* cited by examiner

*Primary Examiner* — Geoffrey Mruk
(74) *Attorney, Agent, or Firm* — Fitzpatrick, Cella, Harper & Scinto

(57) ABSTRACT

A liquid ejection head includes a plurality of liquid ejection units, each including a plate-like piezoelectric element, a first substrate and a second substrate laid one on the other in this order, the units being laid one on the other. The first substrate defines a plurality of pressure chambers for storing liquid, each of the pressure chambers communicating with an ejection port for ejecting liquid. At least either the first substrate or the second substrate defines a first liquid chamber, the first liquid chamber being either one of a feed chamber for feeding liquid to the pressure chambers and a recovery chamber for recovering liquid from the pressure chambers. The second substrate defines a second liquid chamber, the second liquid chamber being the other one of the feed chamber and the recovery chamber.

7 Claims, 6 Drawing Sheets

LIQUID EJECTION HEAD AND LIQUID EJECTION DEVICE

BACKGROUND OF THE INVENTION

Field of the Invention

The present invention relates to a liquid ejection head and a liquid ejection device for ejecting liquid. More particularly, the present invention relates to a flow channel arrangement that can be used for liquid ejection heads realized by employing piezoelectric elements.

Description of the Related Art

Liquid ejection devices for recording images on recording mediums by ejecting liquid such as ink are generally equipped with a liquid ejection head for ejecting liquid. Liquid ejection heads realized by employing piezoelectric elements for the liquid ejection mechanism thereof are known. A liquid ejection head of this type is designed so as to expand/contract its pressure chambers by applying a voltage to the piezoelectric elements, which operate as components of the pressure chambers, in order to produce a pressure change in the pressure chambers. As a result of the pressure change, the liquid in each of the pressure chambers is ejected from the ejection port formed at an end of the pressure chamber. Known liquid ejection heads that include piezoelectric elements include so-called bend-mode liquid ejection heads. A bend-mode liquid ejection head includes plate-shaped piezoelectric bodies, each of which is sandwiched between a pair of electrodes and a diaphragm is rigidly secured to one of the electrodes. Liquid is ejected from the liquid ejection head by applying a voltage to the piezoelectric bodies between the related electrodes so as to expand/contract the piezoelectric bodies in a direction perpendicular to the direction in which the voltage is applied and thereby deforming the diaphragm in an out-of-plane direction (the thickness direction of the plate-shaped piezoelectric bodies). A bend-mode liquid ejection head can deform the diaphragms that form part of the walls of the pressure chambers only by applying a small voltage and hence requires only a low drive voltage.

So-called edge-shooters are known as a type of pressure chambers for forming liquid ejection heads. An edge-shooter has an ejection port formed at one of the longitudinal ends of a pressure chamber and liquid is ejected in a direction running in parallel with the longitudinal direction of the pressure chamber. Japanese Patent No. 5212627 discloses a liquid ejection head in which edge-shooter type pressure chambers are two-dimensionally arranged in planes that are perpendicular to the longitudinal direction of the pressure chambers. The liquid ejection performance of a liquid ejection head is improved by increasing the extent to which each of the pressure chambers of the head can change its volume as a result of deformation of the diaphragm related to pressure chamber. Since pressure chambers having a large length in the longitudinal direction thereof can be realized with ease in a liquid ejection head including edge-shooter type pressure chambers, it is possible for such a liquid ejection head to secure a large area for the plate-shaped diaphragms thereof so as to allow each of the pressure chambers to change its volume to a large extent. For this reason, pressure chambers can be two-dimensionally densely arranged in an edge-shooter type liquid ejection head without damaging the liquid ejection performance of the head.

There has been an increasing demand in recent years for recording apparatus for commercial applications such as print-on-demand type recording apparatus in response to the commercial demand that has also been observed in recent years for forming high resolution and high quality images. However, it is difficult for a liquid ejection head disclosed in Japanese Patent No. 5212627 to remove the air bubbles that have intruded into or otherwise appear in any of the pressure chambers thereof. When air bubbles stagnantly remain in a pressure chamber, the pressure change in the pressure chamber for ejecting liquid is absorbed by the air bubbles remaining there, so that a desired volume of ejected liquid and a desired liquid ejection velocity may not be achieved for the pressure chamber, and such a situation may end up with a serious problem that the pressure chamber can no longer eject liquid. If a pressure chamber cannot eject liquid for a certain period of time, the viscosity of the liquid located at and near the ejection port of the pressure chamber increases to give rise to a clogged ejection port there. Then, a problem of degraded ejection performance and defective ejection can take place.

In view of the above-identified problem, it is therefore the object of the present invention to provide a liquid ejection head including piezoelectric elements that can effectively remove the air bubbles in any of the pressure chambers thereof and suppress any possible increase of liquid viscosity at and near the ejection ports.

SUMMARY OF THE INVENTION

According to the present invention, the above object of the invention is achieved by providing a liquid ejection head comprising a plurality of liquid ejection units, each including a plate-like piezoelectric element, a first substrate and a second substrate laid one on the other in the above-mentioned order, the units being laid one on the other, wherein: the first substrate defines a plurality of pressure chambers for storing liquid, each of the pressure chambers communicating with an ejection port for ejecting the liquid; at least either the first substrate or the second substrate defines a first liquid chamber, the first liquid chamber being either one of a feed chamber for feeding the liquid to the pressure chambers and a recovery chamber for recovering the liquid from the pressure chambers; and the second substrate defines a second liquid chamber, the second liquid chamber being the other one of the feed chamber and the recovery chamber.

Each of the piezoelectric elements is deformed in an out-of-plane direction as a voltage is applied thereto and then expands/contracts the corresponding pressure chambers. Liquid is supplied from the feed chamber to the pressure chambers and the liquid stored in the pressure chambers is ejected from the ejection ports as the pressure chambers expand/contract. If part or all of the liquid is not ejected, it is recovered by the recovery chamber. In a liquid ejection head according to the present invention, a liquid flow starting from the feed chamber and terminating at the recovery chamber by way of the pressure chambers is established even in a state where the liquid ejection head does not eject liquid, so that the air bubbles, if any, contained in the liquid in the pressure chambers are removed from the ejection ports and their vicinity as a result of the liquid flow. Then, liquid can hardly stagnantly remain at and near the ejection ports and hence the liquid ejection head can suppress any possible increase of liquid viscosity at and near the ejection ports thereof.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1:
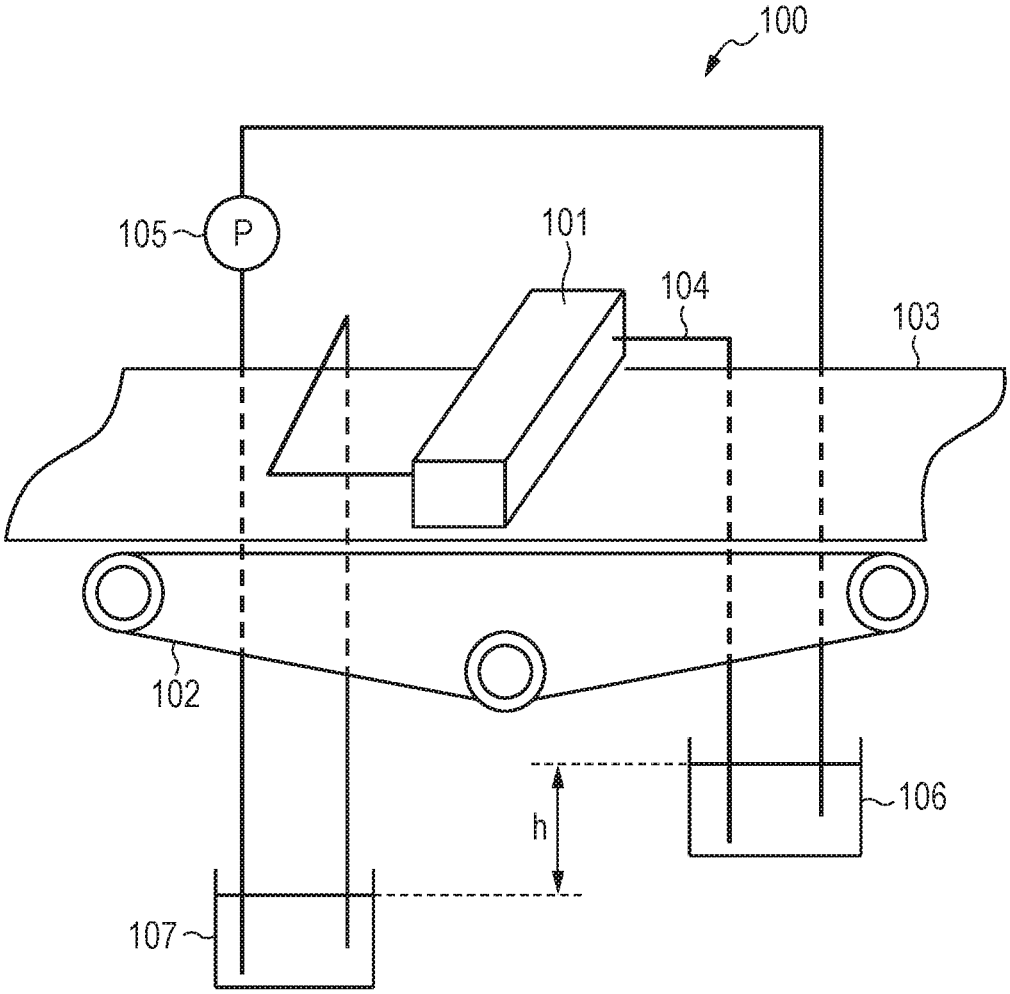
FIG. 1 is a schematic illustration of a liquid ejection device according to the present invention, illustrating the configuration thereof.

Now, a couple of embodiments of the present invention will be described below by referring to the accompanying drawings. While the embodiments of the present invention are described below in terms of inkjet printers, a liquid ejection head according to the present invention can find applications in the field of liquid application devices and shaping devices in addition to ink jet printers. FIG. 1 is a schematic illustration of the first embodiment of liquid ejection device 100 according to the present invention, illustrating the configuration thereof. The liquid ejection device 100 includes a liquid ejection head unit 101 that is equipped with a liquid ejection head, which will be described in greater detail hereinafter. The liquid ejection device 100 of this embodiment is designed for monochromatic printing and hence includes a single liquid ejection head unit 101. However, the liquid ejection device 100 may alternatively include a plurality of liquid ejection head units 101 that eject liquids of different colors in order to accommodate itself to color printing.

A transport device 102 is arranged vis-à-vis the liquid ejection head unit 101. A recording medium 103 is mounted by the transport device 102. An image is formed on the recording medium 103 as liquid ejected from the liquid ejection head unit 101, which is equipped with the liquid ejection head of the invention, is forced to hit the recording medium 103.

As will be described in greater detail hereinafter, the liquid ejection head unit 101, which is equipped with a liquid ejection head, is provided with a main feed flow channel 23 and a main recovery flow channel (see FIGS. 2A to 2C and 4A to 4C). The main feed flow channel 23 and the main recovery flow channel 22 are connected to each other by way of an outside flow channel 104. The outside flow channel 104 is provided with a feed sub-tank 106 and a recovery sub-tank 107. Liquid flows from the feed sub-tank 106 to the recovery sub-tank 107 by way of the liquid ejection head unit 101 due to the differential hydraulic head h between the liquid surface in the feed sub-tank 106 and the liquid surface in the recovery sub-tank 107. Additionally, a pump 105 is arranged in the flow path of the outside flow channel 104 extending from the recovery sub-tank 107 to the feed sub-tank 106 for the purpose of returning the liquid in the recovery sub-tank 107 to the feed sub-tank 106. With the above-described arrangement, liquid can be made to circulate in the liquid ejection head unit 101. Both the liquid surface in the feed sub-tank 106 and the liquid surface in the recovery sub-tank 107 are made to be located below the ejection ports of the liquid ejection head unit 101. Then, as a result, the ejection ports of the liquid ejection head of the liquid ejection head unit 101 are held under negative pressure so that liquid leakage can hardly occur from the ejection ports.

Figure 2A:
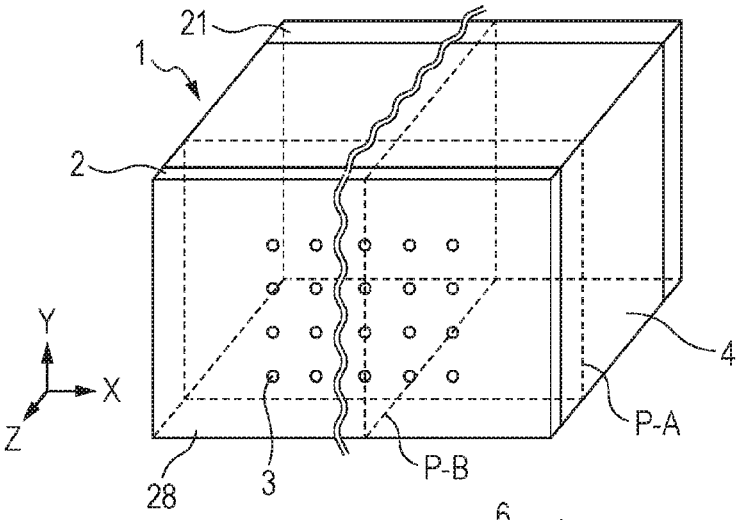
FIGS. 2A, 2B and 2C are schematic conceptual illustrations of the liquid ejection head according to the first embodiment of the present invention.
Figure 2B:
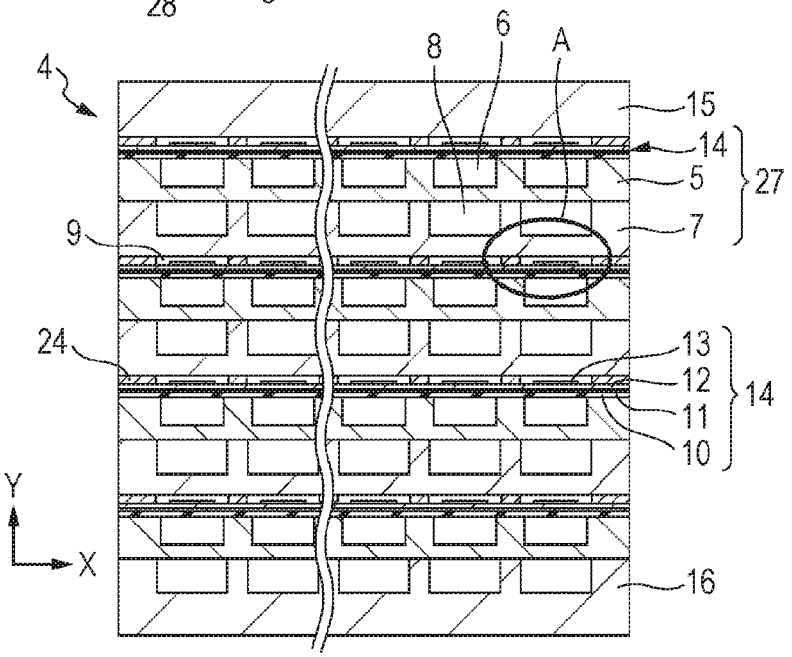
Figure 2C:
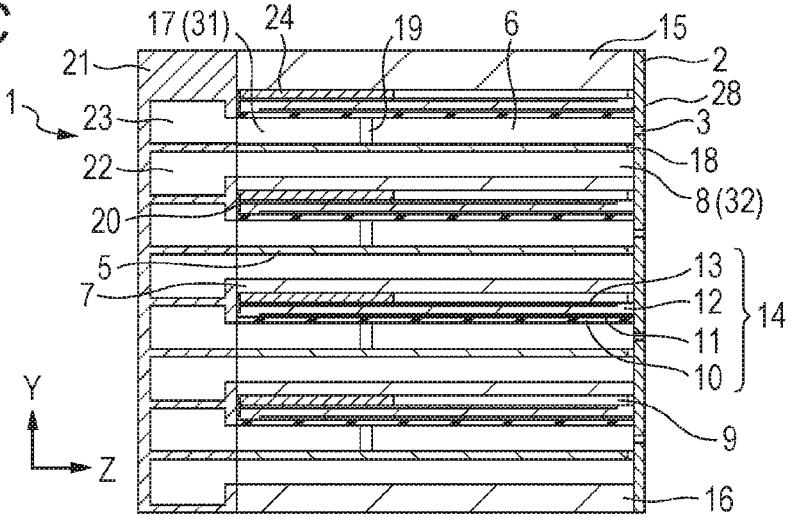

FIG. 2A is a schematic illustration of the configuration of the liquid ejection head 1. FIG. 2B is a schematic cross sectional view of the liquid ejection head 1 taken along plane P-A illustrated in FIG. 2A. FIG. 2C is a schematic cross sectional view of the liquid ejection head 1 taken along plane P-B that passes through some of the ejection ports 3 and some of the pressure chambers 6 of the liquid ejection head 1 as illustrated in FIG. 2A. A first substrate 5, a second substrate 7 and a piezoelectric element 14 that each of the liquid ejection units 27 of the flow channel member 4 of the liquid ejection head 1 includes are sequentially laid one on the other in the direction Y illustrated in FIG. 2A, and liquid is ejected in the direction Z illustrated in FIG. 2A, which is orthogonal to an ejection ports-forming plane 28 where the ejection ports of the liquid ejection head 1 are formed. The direction X illustrated in FIG. 2A is orthogonal to both the direction Y and the direction Z. Note that, in the following description, +X, +Y and +Z respectively refer to the directions of X, Y and Z illustrated in the drawings, whereas −X, −Y and −Z respectively refer to the directions that are opposite to the directions X, Y and Z.

The liquid ejection head 1 includes an ejection port plate 2 where the ejection ports 3 are formed, a flow channel member 4 and a back plate 21. The ejection port plate 2 and the back plate 21 are made of silicon. The ejection ports 3 for ejecting liquid are formed at two-dimensional grid points on the ejection ports-forming plane 28 of the ejection port plate 2. The ejection port plate 2 and the back plate 21 are bonded to the flow channel member 4.

Figure 3A:
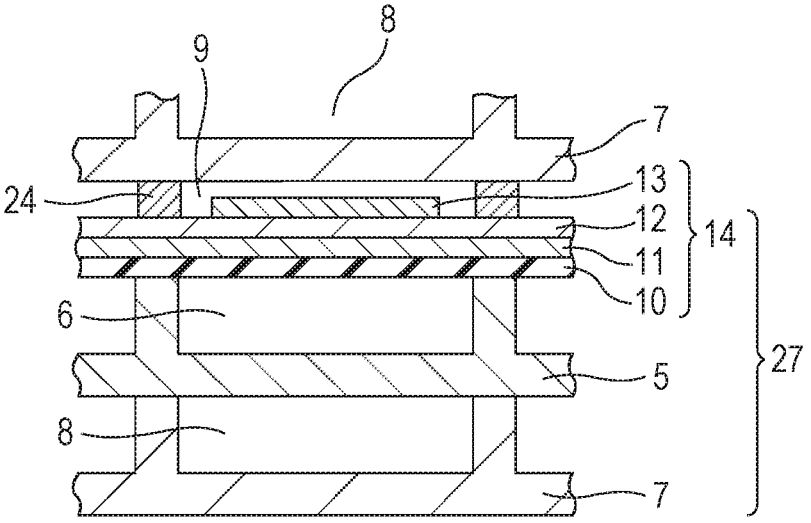
FIGS. 3A and 3B are detailed schematic illustrations of part of the liquid ejection head illustrated in FIGS. 2A to 2C.

Now, the flow channel member 4 will be described in detail below by referring to FIGS. 2B and 3A. FIG. 3A is an enlarged schematic view of the encircled area A in FIG. 2B. In this embodiment, the feed chambers 17 and the recovery chambers 8, which will be described in detail below, are interchangeable. As will be described in detail hereinafter, in each of the liquid ejection units 27, the first substrate 5 defines a plurality of pressure chambers and a plurality of feed chambers 17 while the second substrate 7 defines a plurality of recovery chambers 8. However, it may alternatively be so arranged that the first substrate 5 defines a plurality of pressure chambers 6 and a plurality of recovery chambers 8 while the second substrate 7 defines a plurality of feed chambers 17. In the case of the latter arrangement, the feed chambers 17 of this embodiment operate as so many recovery chambers and the recovery chambers 8 of this embodiment operate as so many feed chambers, whereas the feed ports 19 of this embodiment operate as so many recovery ports and the recovery ports 18 of this embodiment operate as so many feed ports. For this reason, of the feed chambers 17 and the recovery chambers 8 of the flow chamber member 4 of this embodiment, the liquid chambers that are arranged in the first substrate 5 may sometimes be referred to as first liquid chambers 31, whereas the liquid chambers that are arranged in the second substrate 7 may sometimes be referred to as second liquid chambers 32 in the description of this specification. In other words, the first liquid chambers 31 are either the feed chambers 17 or the recovery chambers 8 that respectively correspond to the pressure chambers 6 and the second chambers 32 are the other ones.

In each of the liquid ejection units 27, a plurality of groove-shaped pressure chambers 6 that extend in the Z-direction in parallel with each other are formed on the top surface of the first substrate 5 as viewed in the Y-direction. The pressure chambers 6 are respectively held in communication with the ejection ports 3 for ejecting liquid and store the liquid to be ejected from the ejection ports 3. Additionally, a plurality of groove-shaped feed chambers 17 corresponding to the respective pressure chambers 6 are also formed in parallel with each other at the top surface of the first substrates 5 as viewed in the Y-direction. The second substrate 7 is located under the first substrates 5 (at the −Y side thereof). A plurality of recovery chambers 8 that respectively correspond to the plurality of pressure chambers 6 that are formed in the first substrate 5 are formed on the top surface of the second substrate 7. The plurality of recovery chambers 8 respectively communicate with the corresponding pressure chambers 6. They are groove-shaped and extend in parallel with each other in the Z-direction. The recovery chambers 8 communicate with the respective pressure chambers 6 at respective positions that are different from the positions of the pressure chambers 6 where the feed chambers 17 communicate with the respective pressure chambers 6 in order to recover the liquid that is not ejected from the ejection ports 3. Thus, a liquid ejection unit 27 is formed by a first substrate 5, a second substrate 7 and a piezoelectric element 14. In the liquid ejection unit 27, the first substrate 5 is located between the second substrate 7 and the piezoelectric element 14 as viewed in the Y-direction. The first substrate 5 and the second substrate 7 are made of silicon.

A spacer 24 is arranged under the second substrate 7 of each of the liquid ejection units 27. A plurality of cavities 9 are formed in the spacer 24 so as to correspond to the respective pressure chambers 6 in the first substrate 5. The cavities 9 face the surface of the piezoelectric element 14 of the liquid ejection unit 27 arranged directly under the above-described liquid ejection unit 27 that is opposite to the surface of the piezoelectric element 14 located vis-à-vis the pressure chambers 6 of the lower liquid ejection unit 27. The cavities 9 are groove-shaped and extend in parallel with each other in the Z-direction. In other words, the spacer is arranged between two adjacently located liquid ejection units 27 so as to produce cavities 9 that are located vis-à-vis the pressure chambers 6 of the lower liquid ejection unit 27 with the piezoelectric element 14 of the lower liquid ejection unit 27 interposed between them. The spacers 24 of the liquid ejection head 1 are made of photosensitive film. Alternatively, however, the spacers 24 may be made of a resin-type adhesive.

Thus, a piezoelectric element 14, which includes a diaphragm 10, a common electrode 11, a piezoelectric body and individual electrodes 13, is formed on the first substrate 5 of each of the liquid ejection units 27 as viewed in the Y-direction. The piezoelectric element 14 defines parts of the boundaries or the peripheral walls of the pressure chambers 6 at positions different from the feed chambers 17 and the recovery chambers 8 and the piezoelectric element 14 can be deformed in an out-of-plane direction (the Y-direction). In other words, the piezoelectric element 14 is arranged as a partition wall that defines parts of the pressure chambers 6. The piezoelectric body 12 is formed above the diaphragm 10 with the common electrode 11 interposed between them, the common electrode 11 being formed so as to cover a plurality of pressure chambers 6, and individual electrodes 13 are formed above the piezoelectric body 12 so as to respectively correspond to the individual pressure chambers 6. A bend-mode is adopted for the piezoelectric element 14 so as to cause the diaphragm 10 to be deformed by contracting the piezoelectric body 12 in a direction parallel to the direction of the voltage applied between the common electrode 11 and the individual electrodes 13. A bend-mode can deform a diaphragm 10 to a large extent with a small voltage. In this embodiment, the diaphragm 10 is made of nickel. The common electrode 11 and the individual electrodes 13 may be arranged inversely in the Y-direction so long as the piezoelectric body 12 is sandwiched between the common electrode 11 and the individual electrodes 13.

The flow channel member 4 is formed by laying a plurality of liquid ejection units 27 one on the other in the Y-direction with spacers interposed between them, each of the liquid ejection units 27 being formed by a first substrate 5, a second substrate 7 and a piezoelectric element 14. The cavities 9 formed in each of the spacers cover the regions that are to be deformed of the diaphragm 10 located under the individual electrodes 13 and their surrounding areas as viewed in the Y-direction. In other words, the cavities 9 occupy the regions necessary for deforming the diaphragm 10 in a bend-mode and are covered by the lower surface of the spacer 24 and that of the second substrate 7. As will be described hereinafter for the second embodiment, the spacers 24 may be omitted and each of the second substrates 7 may be provided on the lower surface thereof with recesses that operate as so many cavities 9. The liquid ejection head 1 of this embodiment has a total of four liquid ejection units 27 that are laid one on the other. An upper cover plate 15 is formed on top of the multilayer structure, which is formed by a plurality of (four in this embodiment) liquid ejection units 27, as viewed in the Y-direction. The second substrate of the lowermost liquid ejection unit 27 of the layered liquid ejection units 27 is formed to operate as a lower cover plate 16. No spacer 24 is arranged under the second substrate of the lowermost liquid ejection unit 27 because no cavities 9 need to be formed thereunder. The upper cover plate 15 is made of silicon in this embodiment.

Figure 3B:
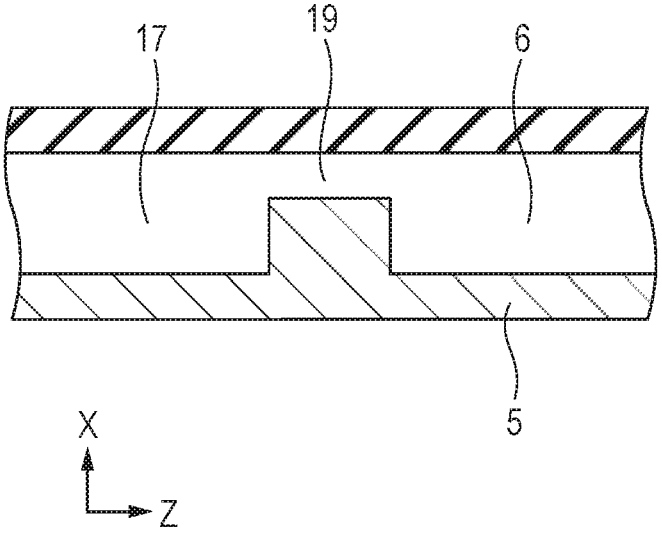

The flow channel arrangement of this embodiment will be described in greater detail below by referring to FIGS. 2C and 3B. FIG. 3B is an illustration of one of the feed ports 19 of the liquid ejection head 1 of this embodiment. Each of the pressure chambers 6 and corresponding one of the recovery chambers 8 communicate with each other by way of a recovery port 18 that is also formed in the first substrate 5. Feed chambers 17 are formed at the rear side (the −Z side) of the first substrate 5 as viewed in the Z-direction and held in communication with the respective pressure chambers 6 by way of respective feed ports 19 that are formed also in the first substrate 5. Each of the feed ports 19 is so formed that its width as viewed in the X-direction is smaller than the width of the pressure chamber 6 and that of the feed chamber 17. With this arrangement, the feed port 19 operates as so-called rearward aperture for controlling the liquid flow between the feed chamber 17 and the pressure chamber 6.

A main feed flow channel 23 for feeding liquid to the plurality of feed chambers 17 arranged in the X-direction and a main recovery flow channel 22 for recovering liquid flowing from the plurality of recovery chambers 8 arranged in the X-direction toward the back plate 21 are formed in the back plate 21. The main feed flow channel 23 and the main recovery flow channel 22 communicate with an outside flow channel 104 at the respective opposite sides of the back plate 21 (see FIG. 1). With this arrangement, the outside flow channel 104 connects the recovery chambers 8 and the feed chambers 17. A feed sub-tank 106 is arranged upstream relative to the main feed flow channel 23, whereas a recovery sub-tank 107 is arranged downstream relative to the main recovery flow channel 22. Liquid is forced to flow from the feed sub-tank 106 to the recovery sub-tank 107 due to the differential hydraulic head h between the liquid surface in the feed sub-tank 106 and the liquid surface in the recovery sub-tank 107. Additionally, a pump 105 is arranged in the outside flow channel 104 extending from the recovery sub-tank 107 to the feed sub-tank 106 for the purpose of returning the liquid in the recovery sub-tank 107 to the feed sub-tank 106. With the above-described arrangement, liquid can be made to circulate in the liquid ejection head 1 (see FIG. 1).

Now, the flow of liquid in the liquid ejection head 1 of this embodiment will be described below. The liquid supplied from each of the feed chambers 17 to the corresponding pressure chamber 6 by way of the corresponding feed port 19 then flows to the corresponding recovery chamber 8 by way of the corresponding recovery port 18. In other words, a liquid flow is produced from the −Z side to the +Z side in the pressure chambers 6. If air bubbles intrude into or otherwise appear in the pressure chamber 6, this liquid flow can remove the air bubbles in the pressure chamber 6 and transfer them to the recovery chamber 8. Then, as a result, a situation where the ejection performance is degraded or no liquid is ejected due to the air bubbles in all or some of the pressure chambers 6 can be prevented from taking place. Additionally, because a liquid flow is constantly observed in the pressure chambers 6, fresh liquid is always fed to and near the ejection ports 3. This liquid flow accelerates the diffusion of the contents in the liquid to effectively prevent the liquid viscosity from rising due to evaporation of liquid at and near the ejection ports 3.

Now, the wiring of the liquid ejection head 1 of this embodiment will be described below by referring to FIGS. 2B and 2C. In the liquid ejection head 1 of this embodiment, the common electrodes 11 are drawn out both in the X-direction and in the −X-direction. On the other hand, each of the individual electrodes 13 extends in the −Z-direction so as to be connected to the related one of the extracting wires 20 arranged at the back plate 21. The extracting wires 20 are made to extend on the back plate 21 and connected to the outside wiring (not illustrated).

Thus, with this embodiment, the air bubbles in the pressure chambers 6 of the bend-mode edge-shooter type liquid ejection head 1 including two-dimensionally arranged pressure chambers 6 can effectively be removed and hence any possible increase of viscosity of the liquid located at and near the ejection ports 3 can be suppressed.

Second Embodiment

Figure 4A:
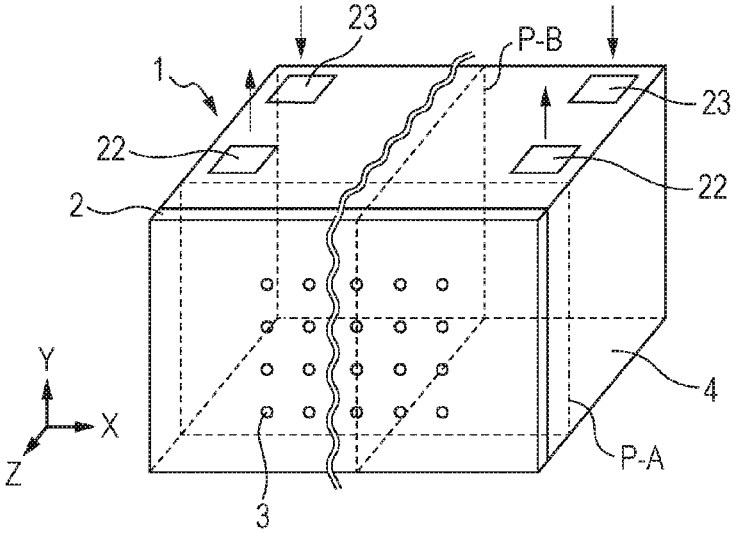
FIGS. 4A, 4B and 4C are schematic conceptual illustrations of the liquid ejection head according to the second embodiment of the present invention.
Figure 4B:
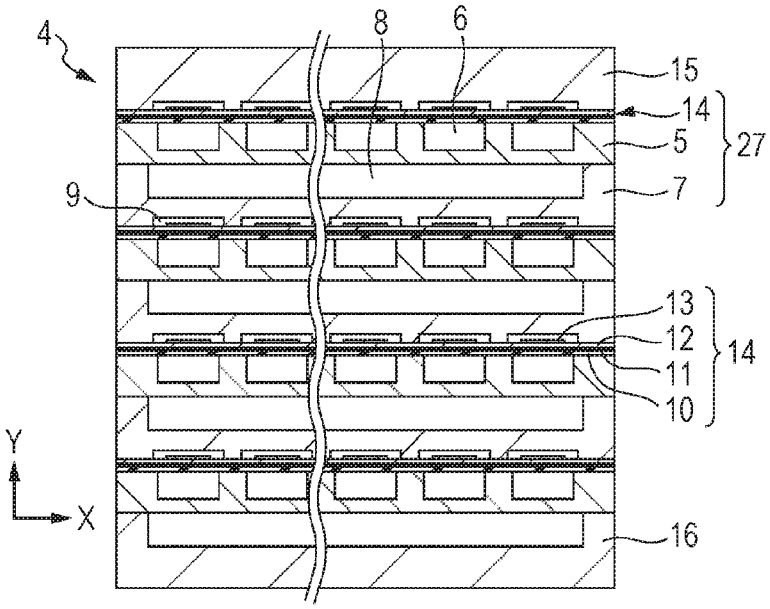
Figure 4C:
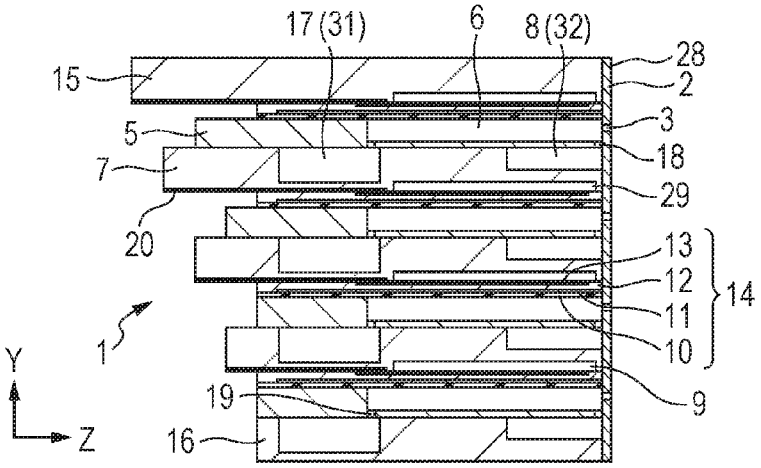

Now, the second embodiment of the present invention will be described below. In the following description, the items that are the same as or similar to those of the first embodiment will not be described any further. FIG. 4A is a schematic illustration of the liquid ejection head 1 of the second embodiment. FIG. 4B is schematic cross sectional view of the liquid ejection head 1 taken along plane P-A in FIG. 4A and FIG. 4C is a schematic cross sectional view of the liquid ejection head 1 taken along plane P-B that passes through some of the ejection ports 3 and some of the pressure chambers 6 of the liquid ejection head 1. As seen from FIG. 4A, this embodiment does not have any back plate and hence allows to omit the steps of manufacturing a back plate and the steps of bonding it to the flow channel member 4 of the liquid ejection head 1.

Now, the flow channel member 4 of this embodiment will be described in detail below by referring to FIG. 4B. In this embodiment, a single recovery chamber 8 is formed on the upper surface of the second substrate 7 in each of all the liquid ejection units 27 of this embodiment. In other words, the pressure chambers 6 of each of the liquid ejection units 27 do not have corresponding recovery chambers. The single recovery chamber 8 extends in a direction that intersects the longitudinal direction of the pressure chambers 8. In other words, the recovery chamber 8 extends in a direction that intersects the direction in which liquid flows in the pressure chambers 6 and preferably in a direction (the X-direction) that orthogonally intersects the direction in which liquid flows in the pressure chambers 6. A plurality of recesses 29 that operate as so many cavities 9 are formed at the lower surface of the second substrate 7. The plurality of recesses 29 are groove-shaped and extend in the Z-direction in parallel with each other so as to respectively correspond to the plurality of pressure chambers 6 formed in the first substrate 5. In other words, the second substrate 7 has recesses 29 that operate as so many cavities 9 at the surface thereof that faces the piezoelectric element 14 of the liquid ejection unit 27 that is arranged next to the second substrate 7. In this embodiment, the recovery chamber 8 and the cavities 9 (recesses 29) of each of the liquid ejection units 27 are formed in the second substrate 7 thereof and hence no spacer 24 is required. As a matter of course, the liquid ejection head 1 can be made to represent a simpler configuration and the steps of laying spacers 24 can be omitted. Note, however, that spacers 24 similar to those of the first embodiment may also be arranged in this second embodiment.

In this embodiment, a plurality of liquid ejection units 27, each including a first substrate 5, a second substrate 7 and a piezoelectric element 14 are laid one on the other in the Y-direction. The second substrate 7 of each of the liquid ejection units 27 is laid such that the cavities 9 thereof cover the individual electrodes 13 and the regions to be deformed of the diaphragm 10 located around the individual electrodes 13 of the liquid ejection unit 27 arranged immediately thereunder as viewed in the Y-direction. An upper cover plate 15 having cavities formed therein is arranged at the top of the multilayer structure, which is realized by laying a plurality of (four in this embodiment) liquid ejection units 27 in the Y-direction. The second substrate 7 of the lowermost liquid ejection unit 27 of the layered liquid ejection units 27 is replaced by a lower cover plate 16 that has not cavities but only has a recovery chamber 8 formed therein because no cavities 9 are required for the lowermost liquid ejection unit 27. In this embodiment, the upper cover plate 15 and the lower cover plate 16 are made of silicon.

Now, the flow channel arrangement of this embodiment will be described in greater detail by referring to FIG. 4C. A single feed chamber 17 is formed at the back of the second substrate 7 (in the −Z-direction) of each of the liquid ejection units 27 so as to correspond to all the pressure chambers 6 of the liquid ejection unit 27 and held in communication with the pressure chambers 6 by way of the feed ports 19 formed at the −Z side of the first substrate 5. Just like the recovery chambers 8, the feed chambers 17 extend in the longitudinal direction of the pressure chambers 6, namely in a direction that intersects the direction in which liquid flows through the pressure chambers 6 and preferably in a direction that orthogonally intersects the direction in which liquid flows through the pressure chambers (X-direction). Each of the feed ports 19 is arranged at the end opposite to the corresponding recovery port 18 as viewed in the longitudinal direction (Z-direction) of the pressure chambers 6. In this embodiment, the feed ports 19 of each of the liquid ejection units 27 are formed at the −Z side ends of the respective pressure chambers 6. With this arrangement, a liquid flow can be produced in each of the entire pressure chambers 6 so that the air bubbles, if any, that remain in the pressure chambers 6 can be removed more effectively.

In this embodiment, a recovery chamber 8 and a feed chamber 17 are formed respectively at the front side and at the back side of the second substrate 7 of each of the liquid ejection units 27 as viewed in the Z-direction and no flow channel is formed at and near the center of the second substrate 7 as viewed in the Z-direction. This arrangement can improve the rigidity of the second substrate 7 and the operation of preparing the liquid ejection head 1 can be simplified.

Figure 5:
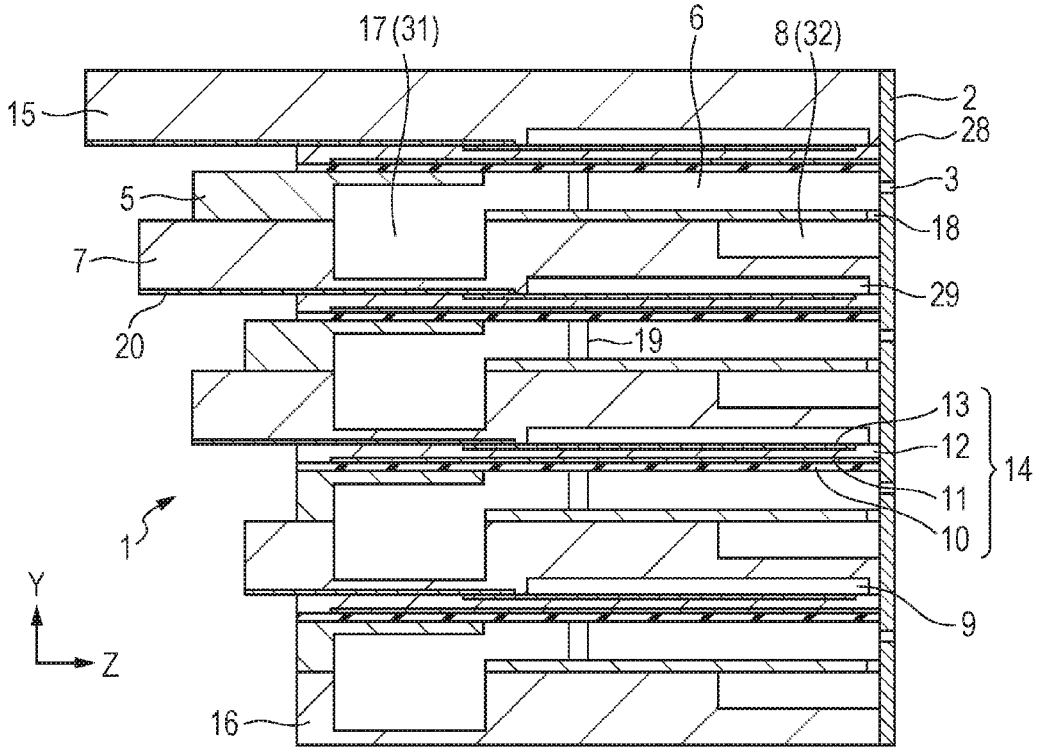
FIG. 5 is a schematic conceptual illustration of a liquid ejection head realized by modifying the second embodiment.

A feed chamber 17 is formed in each of the second substrates 7 in this embodiment. Alternatively, however, the feed chamber 17 may be formed in the first substrate 5 or it may be so formed as to stretch over the first substrate 5 and the second substrate 7. In other words, the single feed chamber 17 can be defined at least by either the first substrate 5 or the second substrate 7. The feed chamber 17 can be made to represent a large flow channel cross section when the feed chamber 17 is formed so as to stretch over the first substrate 5 and the second substrate 7 as illustrated in FIG. 5 and hence this arrangement is preferable from the viewpoint of refilling the liquid ejection head 1 with liquid.

Figure 6A:
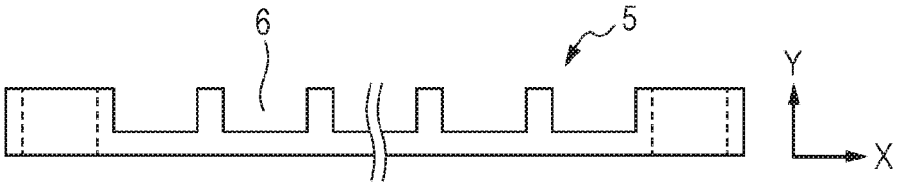
FIGS. 6A and 6B are schematic conceptual illustrations of the first substrate of the liquid ejection head illustrated in FIGS. 4A to 4C.
Figure 6B:
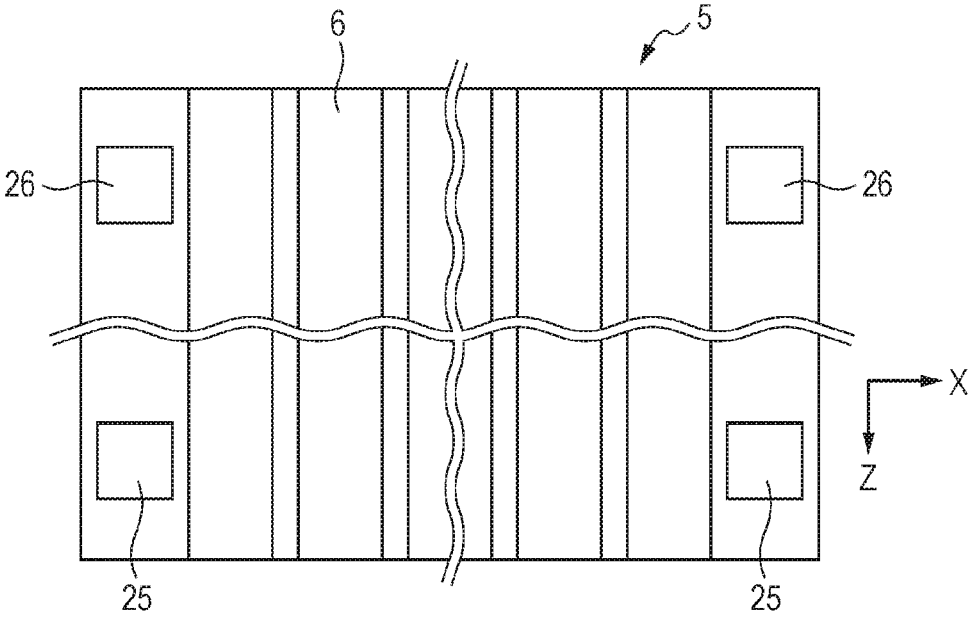

Now, the flow of liquid in the liquid ejection head 1 of the present invention will be described below. FIG. 6A is an illustration of an XY cross section of one of the first substrates 5 of the liquid ejection head 1 of this embodiment. FIG. 6B is an illustration of the first substrate 5 of FIG. 6A as viewed in the +Y-direction. A pair of recovery side holes 25 that communicate with the recovery chambers 8 are formed respectively at the −X side end and at the +X side end of the +Z side of the liquid ejection head 1 in the first substrates 5, the second substrates 7, the piezoelectric elements 14 and the upper cover plate 15. FIG. 6B illustrates one of the first substrates 5 as an example to illustrate how the recovery side holes 25 are formed there. The recovery side holes 25 formed in each of the second substrates 5, in each of the piezoelectric elements 14 and in the upper cover plate 15 are not illustrated in the drawings. The main recovery flow channel 22 is realized by these recovery side holes 25 and connected to the outside flow channel 104 at the top surface of the flow channel member 4 (see FIGS. 1 and 4A). Similarly, a pair of feed side holes 26 that communicate with the feed chambers 17 are formed respectively at the −X side end and at the +X side end of the −Z side of the liquid ejection head 1 in the first substrates 5, the second substrates 7, the piezoelectric elements 14 and the upper cover plate 15. FIG. 6B illustrates one of the first substrates as an example to illustrate how the feed side holes 26 are formed there. The feed side holes 26 formed in each of the second substrates 5, in each of the piezoelectric elements 14 and in the upper cover plate 15 are not illustrated in the drawings. The main feed flow channel 23 is realized by these feed side holes 26 and connected to the outside flow channel 104 at the top surface of the flow channel member 4 (see FIGS. 1 and 4A).

In each of the liquid ejection units 27, the liquid supplied from the feed chamber 17 to the pressure chambers 6 by way of the feed ports 19 flows to the recovery chamber 8 by way of the recovery ports 18. In other words, a liquid flow that flows through the pressure chambers is produced from the −Z side to the +Z side. If air bubbles intrude into or otherwise appear in any of the pressure chambers 6, this liquid flow can remove the air bubbles in the pressure chambers 6 and transfer them to the recovery chamber 8. Then, as a result, a situation where the ejection performance is degraded or no liquid is ejected due to the air bubbles in all or some of the pressure chambers 6 can be prevented from taking place. Additionally, because a liquid flow is constantly observed in the pressure chambers 6, fresh liquid is always fed to and near the ejection ports 3. This liquid flow accelerates the diffusion of the viscous contents in the liquid to effectively prevent the liquid viscosity from rising due to evaporation of liquid at and near the ejection ports 3.

The common electrode 14 is drawn out both in the X-direction and in the −X direction in each of the liquid ejection units 27 of the liquid ejection head 1 of this embodiment. On the other hand, each of the individual electrodes 13 is drawn out in the −Z direction and connected to an extracting wire 20 formed on the bottom surface of the first substrate 5 as viewed in the Y-direction. As illustrated in FIG. 4C, the first substrates 5 of all the liquid ejection units 27 are made to represent different lengths. In other words, the first substrates 5 are made to represent respective lengths that sequentially decrease in the −Y direction. As a result, the liquid ejection units 27 represent uneven ends at the −Z side. This arrangement allows the extracting wires 20 to be connected to the outside wire with ease at the −Z side.

Thus, the bend-mode edge-shooter type liquid ejection head 1 including two-dimensionally arranged pressure chambers 6 of this embodiment can effectively remove air bubbles, if any, in the pressure chambers 6 and suppress any possible increase of liquid viscosity at and near the ejection ports 3. At the same time, the rigidity of the second substrates 7 can be improved and the manufacturing steps of preparing a back plate and spacers and bonding them can be omitted so that the process of manufacturing a liquid ejection head 1 can be simplified.

In this embodiment again, the feed chambers 17 and the recovery chambers 8 are interchangeable. In other words, when a first liquid chamber 31 is operated as a single feed chamber 17 or a single recovery chamber 8 and a second liquid chamber 32 is operated as the other, in each of the liquid ejection units 27, at least either the first substrate 5 or the second substrate 7 defines the single first liquid chamber 31 and the second substrate 7 defines the single second liquid chamber 32.

Thus, the present invention can provide a liquid ejection head including piezoelectric elements that can effectively remove the air bubbles, if any, in any of the pressure chambers thereof and suppress any possible increase of liquid viscosity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of the Japanese Patent Application No. 2015-002205, filed Jan. 8, 2015, which is hereby incorporated by reference herein in its entirety.

What is claimed is:

1. A liquid ejection head comprising a plurality of liquid ejection units, each including a plate-like piezoelectric element, a first substrate and a second substrate laid one on the other in the above-mentioned order, the units being laid one on the other, wherein:

the first substrate defines a plurality of pressure chambers for storing liquid, each of the pressure chambers communicating with an ejection port for ejecting the liquid;

at least either the first substrate or the second substrate defines a first liquid chamber, the first liquid chamber being either one of a feed chamber for feeding the liquid to the pressure chambers and a recovery chamber for recovering the liquid from the pressure chambers;

the second substrate defines a second liquid chamber, the second liquid chamber being the other one of the feed chamber and the recovery chamber; and the second substrate of one of two adjacently located liquid ejection units has a plurality of recesses in the surface thereof facing the piezoelectric element of the other of the two liquid ejection units so as to form cavities between the above surface and the surface of the piezoelectric element opposite to the surface thereof facing the pressure chambers of the other of the two liquid ejection units.

2. The liquid ejection head according to claim 1, wherein at least either the first substrate or the second substrate of each of the liquid ejection units defines a plurality of first liquid chambers and the second substrate defines a plurality of second liquid chambers, each of the plurality of first liquid chambers and the plurality of second liquid chambers communicating with one of the plurality of pressure chambers of the same unit so as to feed or recover the liquid.

3. The liquid ejection head according to claim 1, wherein at least either the first substrate or the second substrate of each of the liquid ejection units defines a single first liquid chamber and the second substrate defines a single second liquid chamber, the single first liquid chamber and the single liquid chamber communicating with all the plurality of pressure chambers of the same unit so as to feed or recover the liquid.

4. The liquid ejection head according to claim 3, wherein the second liquid chamber extends in a direction that intersects the direction in which the liquid flows in the pressure chambers.

5. The liquid ejection head according to claim 3, wherein the first liquid chamber stretches over the first substrate and the second substrate.

6. The liquid ejection head according to claim 1, wherein the piezoelectric element of each of the liquid ejection units has a common electrode stretching over the plurality of pressure chambers of the same unit, individual electrodes respectively corresponding to the plurality of pressure chambers and a piezoelectric body sandwiched between the common electrode and the individual electrodes.

7. A liquid ejection device having a liquid ejection head comprising a plurality of liquid ejection units, each including a plate-like piezoelectric element, a first substrate and a second substrate laid one on the other in the above-mentioned order, the units being laid one on the other, wherein:

the first substrate defines a plurality of pressure chambers for storing liquid, each of the pressure chambers communicating with an ejection port for ejecting the liquid;

at least either the first substrate or the second substrate defines a first liquid chamber, the first liquid chamber being either one of a feed chamber for feeding the liquid to the pressure chambers and a recovery chamber for recovering the liquid from the pressure chambers;

the second substrate defines a second liquid chamber, the second liquid chamber being the other one of the feed chamber and the recovery chamber; and the second substrate of one of two adjacently located liquid ejection units has a plurality of recesses in the surface thereof facing the piezoelectric element of the other of the two liquid ejection units so as to form cavities between the above surface and the surface of the piezoelectric element opposite to the surface thereof facing the pressure chambers of the other of the two liquid ejection units, the device further having:

an outside flow channel connecting the recovery chambers and the feed chambers; and a pump arranged in the outside flow channel to circulate the liquid.

* * * * *